US007549845B2

(12) United States Patent
Uwami et al.

(10) Patent No.: US 7,549,845 B2
(45) Date of Patent: Jun. 23, 2009

(54) GAS TURBINE HAVING A SEALING STRUCTURE

(75) Inventors: Takuya Uwami, Takasago (JP); Rintaro Chikami, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 75 days.

(21) Appl. No.: 11/316,900

(22) Filed: Dec. 27, 2005

(65) Prior Publication Data

US 2006/0239814 A1 Oct. 26, 2006

(30) Foreign Application Priority Data

Feb. 7, 2005 (JP) ..... 2005-030170

(51) Int. Cl.
*F01D 5/06* (2006.01)

(52) U.S. Cl. ..... 416/198 A; 416/95; 277/630; 277/637; 277/640; 411/549

(58) Field of Classification Search ..... 416/198 A, 416/199, 200 A, 201 R, 95; 415/135–136, 415/138–139, 170.1, 174.2; 277/455, 630, 277/637, 640; 411/549, 553, 554
See application file for complete search history.

(56) References Cited

U.S. PATENT DOCUMENTS 3,486,205 A * 12/1969 Smith ..... 411/549
3,801,220 A * 4/1974 Beckershoff ..... 416/198 R
4,274,805 A * 6/1981 Holmes ..... 415/138
4,314,793 A * 2/1982 DeTolla et al. ..... 415/135
5,865,600 A 2/1999 Mori et al.
6,315,301 B1 11/2001 Umemura et al.
6,692,228 B2 * 2/2004 Turnquist et al. ..... 415/174.2

FOREIGN PATENT DOCUMENTS

| | | |
|---|---|---|
| CA | 2 287 509 A1 | 9/1999 |
| JP | H09-133005 | 5/1997 |
| JP | H11-247999 | 9/1999 |

* cited by examiner

*Primary Examiner*—Christopher Verdier
(74) *Attorney, Agent, or Firm*—Kanesaka Berner & Partners

(57) ABSTRACT

In a gas turbine, annular overhang portions are formed on adjacent surfaces of a plurality of rotor discs so as to face each other, surrounding the rotor axis, groove portions are provided circumferentially to the surfaces of the overhang portions facing each other, and sealing structures are annularly installed to the inside of the groove portions. The gas turbine comprises sealing plate assemblies which include the overhang portions, the groove portions and a plurality of plates being formed annularly by being mutually piled up; and detachable retaining members which are provided so as to fix the overhang portions and the sealing plate assemblies together by way of disc engagement portions provided to the overhang portions and sealing plate engagement portions provided to the sealing plate assemblies.

12 Claims, 9 Drawing Sheets

GAS TURBINE HAVING A SEALING STRUCTURE

The present invention is based on Japanese Patent Application No. 2005-030170 filed on Feb. 7, 2005.

BACKGROUND OF THE INVENTION

1. Field of the Invention

The present invention relates to a gas turbine being provided with a sealing structure preventing combustion gas or a cooling medium from leaking between rotor discs of the gas turbine.

2. Description of the Prior Art

A general construction of a gas turbine is shown in FIG. 8. The gas turbine compresses air in a compressor 51 and subsequently introduces the compressed air to a combustor 52. The combustor 52 generates combustion gas by supplying fuels to the compressed air and introduces the generated combustion gas to a turbine 53. The turbine 53 rotates by the combustion gas, and electric power is produced from a generator 54.

In order to enhance the efficiency of a gas turbine, it is necessary to generate higher temperature combustion gas. Therefore, a cooling medium such as a cooling air or a cooling steam and the like is used for the purpose of cooling of rotating and stationary blades. For an example, a case will be explained hereinafter where a part of the compressed air from the compressor 51 is used as a cooling medium.

FIG. 9 is a cross-sectional view showing the inside of the turbine 53. The turbine 53 is provided with a rotor having a plurality of rotor discs 60 installed around a rotor axis 58. FIG. 10 is a perspective view showing a part of a sealing construction of adjacent rotor discs 60 facing each other. The adjacent rotor discs 60 have an overhang portion 3 (sometimes referred as a "disc land") formed on the surfaces thereof facing each another. The overhang portions 3 are formed in the form of a ring around the rotor axis 58, projecting to face each other.

The surfaces facing each other at the edge of the overhang portions 3 have a groove portion 4 provided circumferentially. An annular sealing plate assembly 71 is inserted into the groove portions 4 circumferentially. When the rotor discs 60 rotate, the sealing plate assembly 71 is pressed outward in the radial direction of the groove portions 4 due to a centrifugal force.

As a result, the inner surfaces of the groove portions 4 and the outer surface of the sealing plate assembly 71 are attached firmly. Consequently, as shown in FIG. 9, a cooling air 57 being introduced into the inside of the rotor is prevented from flowing out to the gas paths 55 of the turbine 53. Moreover, the combustion gas 56 flowing in from the combustor 52 and passing through the gas paths 55 is prevented from flowing into the inside of the rotor.

A concrete construction of such a sealing plate assembly 71 as described hereinabove is disclosed in Japanese Patent Application Laid-Open No. H11-247999. FIG. 11 and FIG. 12 are a perspective view and a cross-sectional view showing the sealing plate assembly 71, respectively. The sealing plate assembly 71 consists of two-ply sealing plates including an outside sealing plate 74 and an inside sealing plate 75, and a leaf spring 72. A locking pin 73 is firmly fixed to the outside sealing plate 74 by welding. The inside sealing plate 75 is fixed by means of the locking pin 73, thereby preventing circumferential misalignment between the outside sealing plate 74 and the inside sealing plate 75.

In addition, the outside sealing plate 74 and the inside sealing plate 75 are divided into a plural number circumferentially. An annular sealing plate assembly 71 is constructed by having a leaf spring 72 installed to the inside of the inside sealing plate 75. As shown in FIG. 10, the sealing plate assembly 71 being constructed as described hereinabove is inserted into the inside of the groove portions 4 of the overhang portions 3 so as to be assembled to the rotor discs 60.

In the conventional sealing plate assembly 71 as described hereinabove, the outside sealing plate 74, the inside sealing plate 75 and the leaf spring 72 are restrained from mutual relative movement by the locking pin 73. However, because the sealing plate assembly 71 is not fixed to the rotor discs 60, relative movement in an integrated manner is possible inside the groove portions 4.

During steady operation of a gas turbine, the rotor discs 60 are operated at the rated speed. Therefore, the sealing plate assemblies 71 are pressed outward in the radial direction of the groove portions 4 by the centrifugal force and do not make relative movements to the rotor discs 60. When the rotor discs 60 rotate at a low speed, the pressing force due to the centrifugal force is small, which causes such looseness to occur as the sealing plate assemblies 71 make relative movements circumferentially and axially inside the groove portions 4. As a result, there arises a problem that the sealing plate assemblies 71 will get worn or damaged in course of time, which requires a periodical replacement.

Moreover, the sealing plate assembly 71 has the outside sealing plate 74 and the inside sealing plate 75 integrated by the locking pin 73 being fixed firmly to the outside sealing plate 74 by welding. Therefore, in order to replace sealing plate assemblies 71 during a periodical overhaul inspection, it is necessary to bring the main gas turbine body back to a factory to disassemble the turbine. As a result, costs of a periodical overhaul inspection increase and a unit outage period becomes longer, which causes a problem that maintenance costs will further increase.

SUMMARY OF THE INVENTION

It is an object of the present invention to solve such problems as described hereinabove, aiming at reducing the replacement frequency of sealing plate assemblies and providing a gas turbine which can have sealing plate assemblies thereof replaced easily at the site.

In order to achieve the above-mentioned object, a gas turbine in accordance with the present invention comprises:

a plurality of rotor discs which respectively include overhang portions formed annularly around a rotor axis, facing mutually adjacent rotor discs, and groove portions formed circumferentially on end surfaces of the overhang portions that face each other;

sealing structures which are provided in the groove portions and formed annularly; wherein a sealing structure comprises a disc engagement portion provided to the overhang portion, and a sealing plate assembly including a plurality of annular sealing plates piled up mutually, and sealing plate engagement portions provided to the sealing plates;

retaining members which are engaged to the disc engagement portions and the sealing plate engagement portions so as to have the sealing plate assemblies disengageably fixed to the overhang portions.

Additionally, in the gas turbine system in accordance with the present invention as described hereinabove, the disc engagement portion is provided so as to house a retaining member therein, and the sealing plate engagement portion is provided to a sealing plate assembly in the form of a hole.

Moreover, in the gas turbine in accordance with the present invention as described hereinabove, the disc engagement portion is provided to the overhang portion in the form of a hole, and the sealing plate engagement portion is provided to the border of the sealing plate assembly in the form of an arc.

DESCRIPTION OF THE PREFERRED EMBODIMENTS

Figure 1:
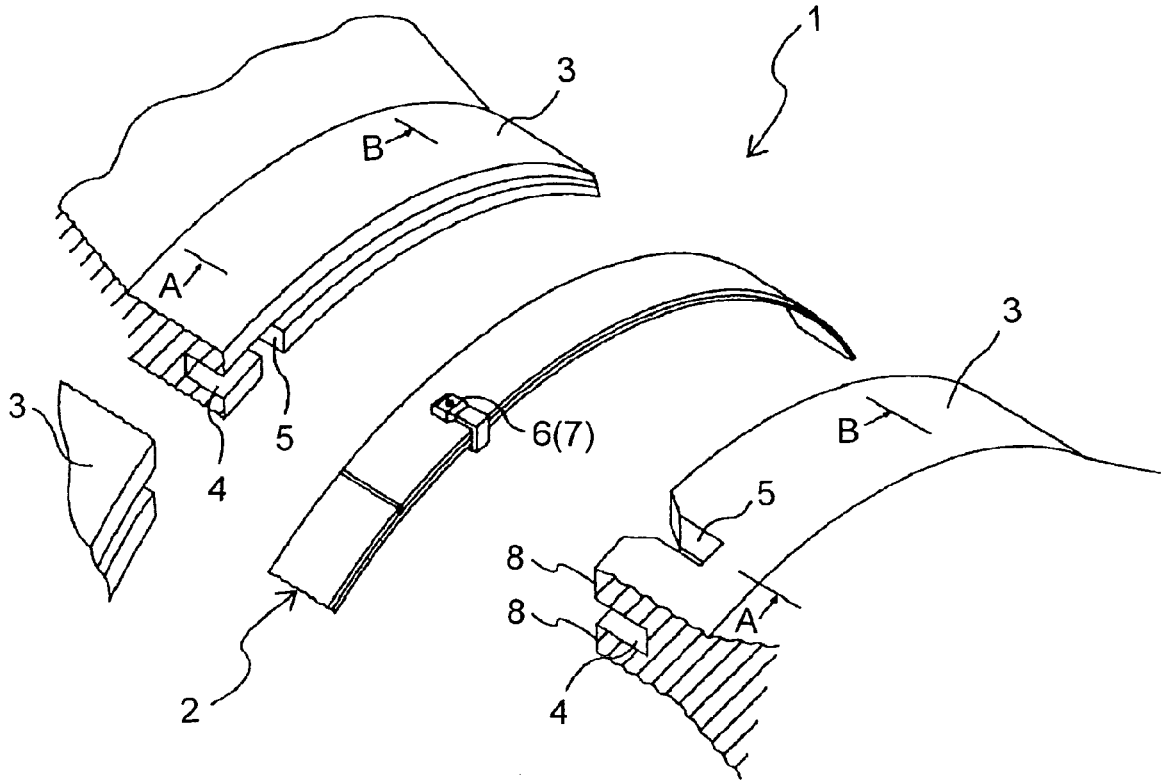
FIG. 1 is a perspective view showing a sealing structure of a gas turbine in accordance with a first embodiment of the present invention.

Referring now to the drawings, embodiments of the present invention will be described hereinafter. The following embodiments are examples of the present invention and not limited to. A sealing structure of a gas turbine in accordance with the present invention comprises overhang portions being provided to rotor discs; groove portions being provided to the overhang portions, a sealing plate assembly being inserted into the groove portions, and retaining members; wherein, a sealing plate assembly consists of an outside sealing plate and an inside sealing plate.

Figure 8:
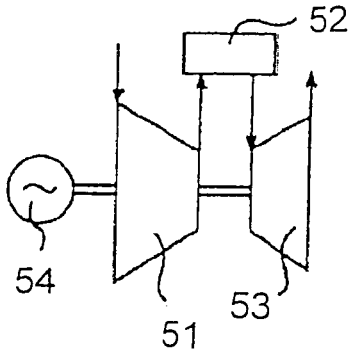
FIG.8 PRIOR ART
FIG. 8 is a schematic diagram showing a general construction of a gas turbine.
Figure 9:
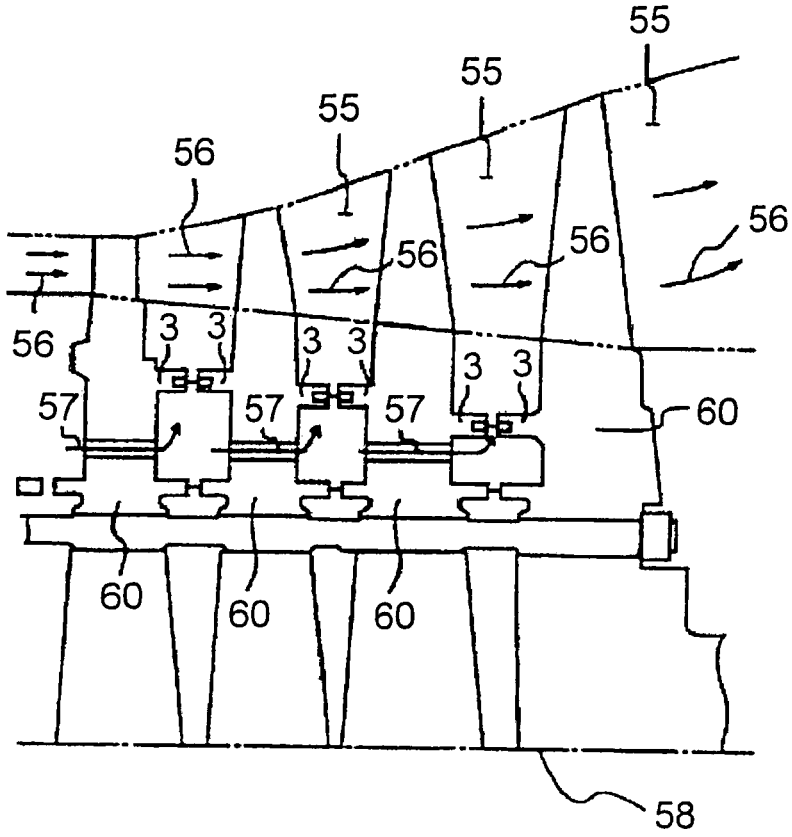
FIG.9 PRIOR ART
FIG. 9 is a cross-sectional view showing the inside of a turbine of a conventional gas turbine.
Figure 10:
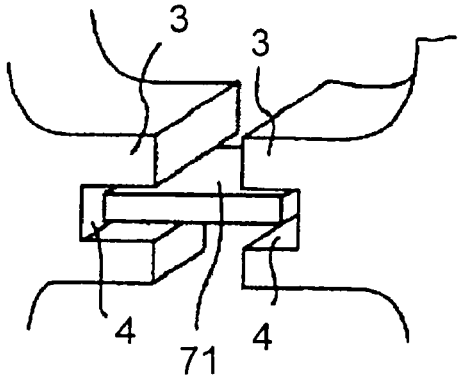
FIG.10 PRIOR ART
FIG. 10 is a perspective view showing a sealing structure of a conventional gas turbine.
Figure 11:
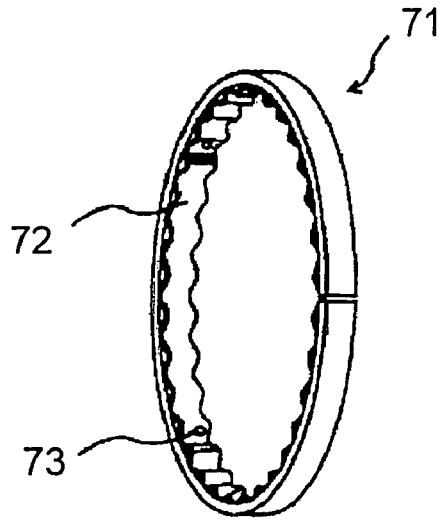
FIG.11 PRIOR ART
FIG. 11 is a perspective view showing a sealing plate assembly of a conventional gas turbine.

In addition, the construction of the gas turbine in accordance with the present invention and the structure of the rotor discs are the same as the conventional examples that are shown in FIG. 8 through FIG. 10. Therefore, same symbols will be applied to the same portions as in FIG. 8 through FIG. 10 and the detailed description thereof will be omitted.

Figure 2A:
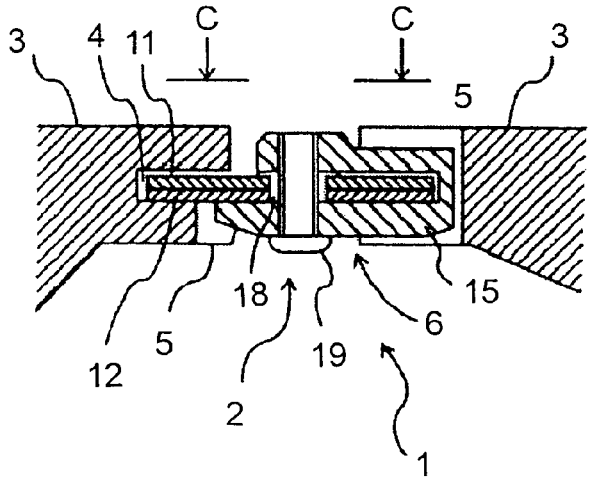
FIG. 2A is a cross-sectional view of FIG. 1 along the line A-A.
Figure 2B:
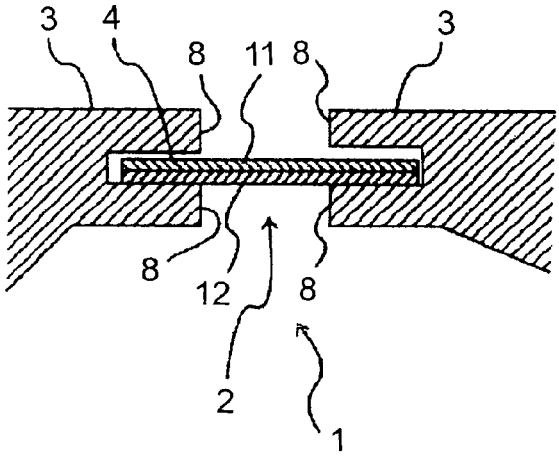
FIG. 2B is a cross-sectional view of FIG. 1 along the line B-B.
Figure 2C:
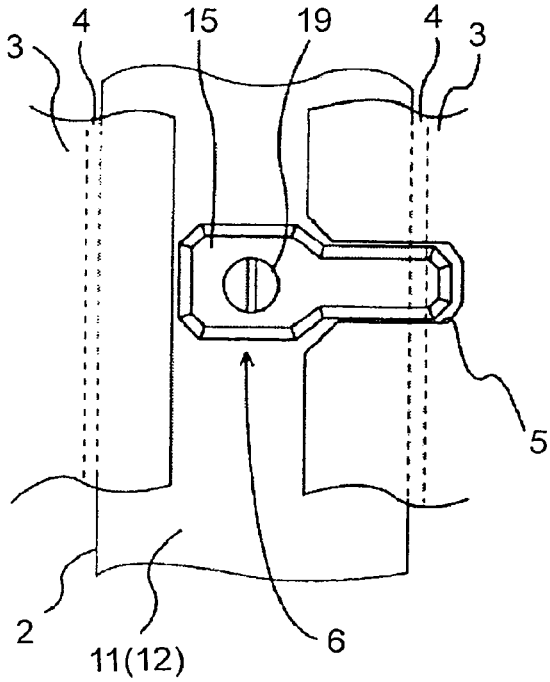
FIG. 2C is a plan view showing a sealing structure of the gas turbine in accordance with the first embodiment of the present invention.

FIG. 1 is a perspective view showing a sealing structure of a gas turbine in accordance with a first embodiment. FIG. 2A and FIG. 2B are cross-sectional views of FIG. 1 along the lines A-A and B-B, respectively. Additionally, FIG. 2C is a plan view showing the sealing structure. The sealing structure 1 seals adjacent rotor discs 60 and consists of overhang portions 3, disc engagement portions 5, groove portions 4, a sealing plate assembly 2 and retaining members 6.

The overhang portion 3 is provided annularly, projecting from the rotor disc 60. The overhang portion 3 is provided with the disc engagement portion 5. The groove portion 4 is provided to the overhang portion 3 annularly, having the sealing plate assembly 2 inserted therein. The overhang portion 3 has annular projecting portions 8 formed on both sides of the groove portion 4. A position facing and being opposite to the overhang portion 3 has an overhang portion 3 including a similar groove portion 4 project from an adjacent rotor disc 60. The sealing plate assembly 2 is used in a condition of being housed in the inside of the groove portions 4 being provided to the surfaces of the overhang portions 3 on both sides that face each other.

The overhang portion 3 of the rotor disc 60 is provided with the disc engagement portion 5 which can house a retaining member 6. The disc engagement portion 5 penetrates through the groove portion 4 being provided to the overhang portion 3 in the radial direction of the rotor and is dented in the axial direction of the rotor for a predetermined length from the end surface of the overhang portion 3 so as to be formed in the shape of a groove. As a result, the disc engagement portion 5 is made large enough for the retaining member 6 to be inserted therein. In addition, a plurality of disc engagement portions 5 are provided circumferentially in accordance with the retaining members 6. Moreover, the disc engagement portion 5 may be provided to both of the overhang portions 3 that face each other or may be provided to only one overhang portion 3.

Figure 3:
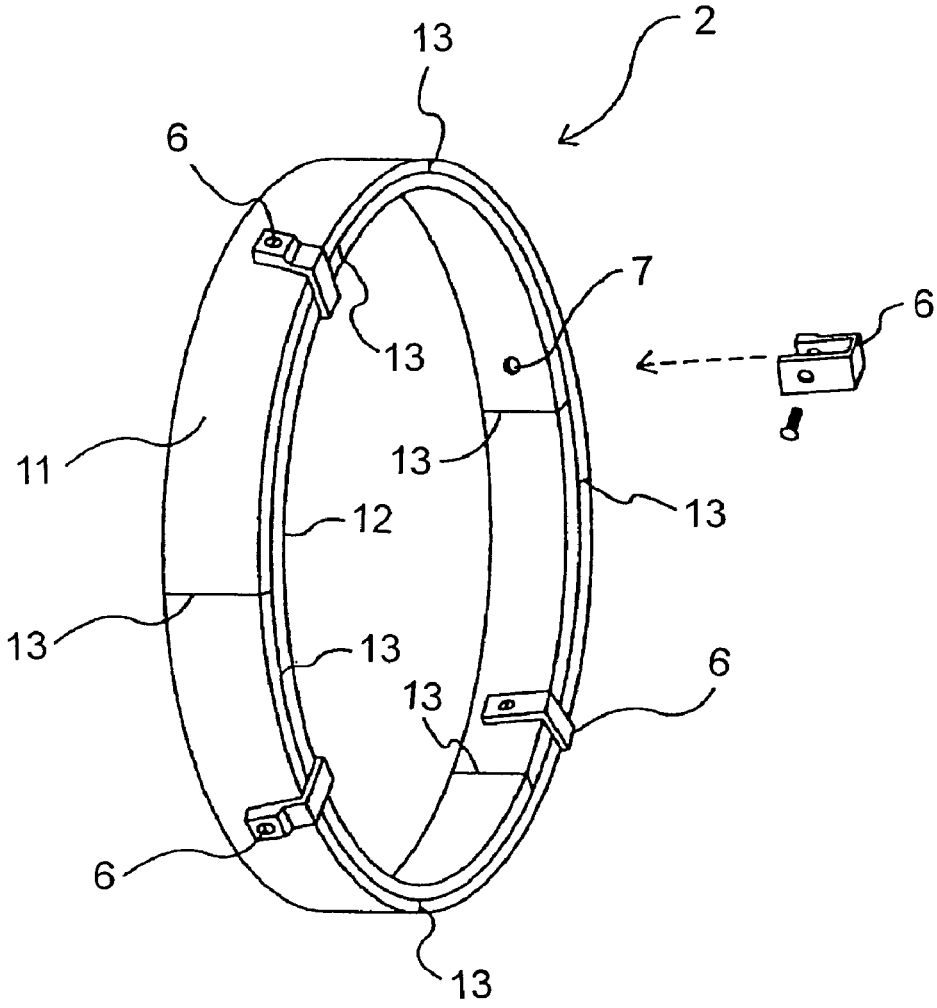
FIG. 3 is a perspective view showing a sealing plate assembly of the gas turbine in accordance with the first embodiment of the present invention.

FIG. 3 is a perspective view showing a sealing plate assembly 2. The sealing plate assembly 2 has an outside sealing plate 11 and an inside sealing plate 12. The outside sealing plate 11 and the inside sealing plate 12 are fixed firmly in an integrated manner at a plurality of circumferential positions by the retaining members 6.

The outside sealing plate 11 and the inside sealing plate 12 comprise a plurality of members being divided circumferentially, and between the members are provided dividing portions 13 consisting of gaps. Thermal expansion and shrinkage of the outside sealing plate 11 and the inside sealing plate 12 can be absorbed by the dividing portions 13. In addition, the outside sealing plate 11 and the inside sealing plate 12 are generally divided into two to four circumferentially, but not limited to.

Moreover, the dividing portions 13 of the outside sealing plate 11 and the inside sealing plate 12 are assembled, being displaced so as to be mutually provided with a phase difference circumferentially. Therefore, sealing can be achieved even when the gaps of the dividing portions 13 of the outside sealing plate 11 become somewhat larger due to thermal expansion and shrinkage.

Specifically, due to a centrifugal force being generated by rotation of the rotor discs 60, the outside sealing plate 11 and the inside sealing plate 12 rotate, being attached firmly. Therefore, combustion gas leaking from the dividing portions 13 of the outside sealing plate 11 is sealed by the surfaces of the outside sealing plate 11 and the inside sealing plate 12 that are attached firmly, thereby eliminating a concern that combustion gas intrudes into the inside of the inside sealing plate 12.

Similarly, even when the dividing portions 13 of the inside sealing plate 12 become larger, there is no concern that a cooling medium inside the rotor flows out to the gas path from the outside sealing plate 13. There is no limit to the relative phase difference (misalignment amount) between the outside sealing plate 11 and the inside sealing plate 12, but an optional phase difference (misalignment amount) can be adopted as long as sealing is possible. In addition, the retaining member 6 may be provided to one location or may be provided to a plurality of locations for each divided member of the outside sealing plate 11 and the inside sealing plate 12.

Figure 4A:
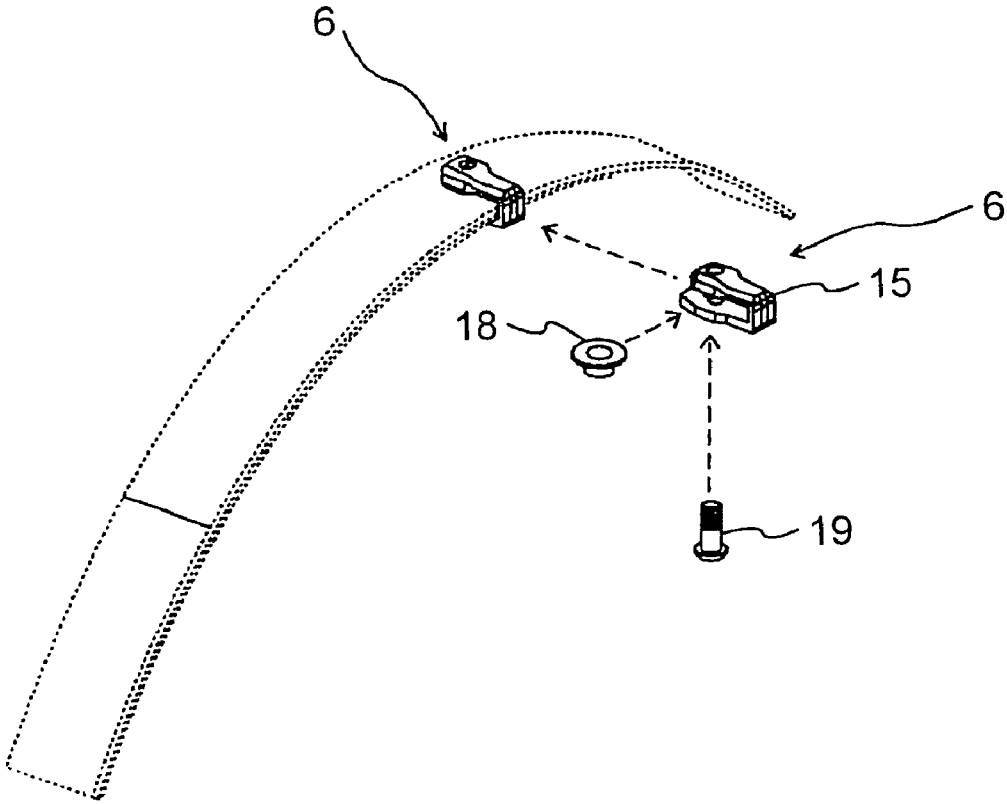
FIG. 4A is a perspective view showing a retaining member of the gas turbine in accordance with the first embodiment of the present invention.
Figure 4B:
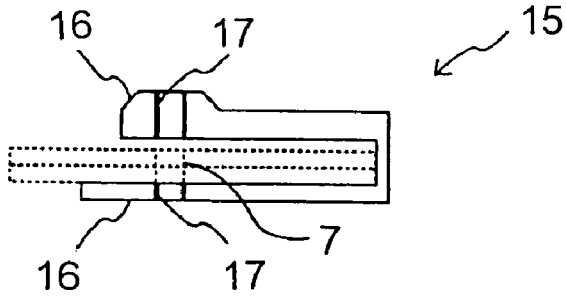
FIG. 4B is a lateral cross-sectional view showing a retaining member of the gas turbine in accordance with the first embodiment of the present invention.

FIG. 4A and FIG. 4B are a perspective view and a lateral cross-sectional view showing the construction of a retaining member 6, respectively. The retaining member 6 comprises a grasping member 15, an intermediate holding member 18 and a locking bolt 19. The outside sealing plate 11 and the inside sealing plate 12 have a sealing plate engagement portion 7 (See FIG. 3.) bored therein which opens in the form of a hole for insertion of the locking bolt 19.

The grasping member 15 is formed so as to have a cross section in a U-shaped form and sandwiches the outside sealing plate 11 and the inside sealing plate 12 with two pieces of the upper and the lower grasping portions 16 that face each other. The upper and the lower grasping portions 16 have a bolt hole 17 formed therein to receive a locking bolt 19. An intermediate holding member 18 having a through hole is provided between the upper and the lower grasping portions 16, and the intermediate holding member 18 is inserted into the sealing plate engagement portions 7 of the outside sealing plate 11 and the inside sealing plate 12.

Additionally, a locking bolt 19 is inserted through the bolt hole 17 and the intermediate holding member 18 from the inside of the rotor, so as to fix the retaining member 6 together with the sealing plate assembly 2 in an integrated manner. Also, the locking bolt 19 has a threaded portion provided to a part of the overall length thereof, so that by turning the locking bolt 19, the outside sealing plate 11 and the inside sealing plate 12 can be tightened.

Moreover, because the outside sealing plate 11 and the inside sealing plate 12 are fixed by way of the intermediate holding member 18, the outside sealing plate 11 and the inside sealing plate 12 do not directly come into contact with the locking bolt 19. Therefore, although the sealing plate assembly 2 is loosened, there is no concern that the threaded portion of the locking bolt 19 gets damaged.

In addition, because the disc engagement portions 5 are provided to the edges of the overhang portions 4, on-site machining of the disc engagement portions 5 is possible without deteriorating the machine accuracy. Therefore, although the existing turbine is not provided with disc engagement portions 5, on-site additional machining makes it further easier to replace the sealing plate assemblies 2 at the site.

In accordance with the construction as described hereinabove, by inserting the locking bolt 19 into the sealing plate engagement portions 7, the sealing plate assembly 2 is firmly fixed in the integrated manner by the retaining members 6. Additionally, the retaining members 6 are engaged into the disc engagement portions 5 being provided to the overhang portions 3, which keeps the sealing plate assembly 2 rested on the overhang portions 3 of the rotor discs 60. Therefore, while the rotor is rotating at a low speed, it is possible to restrain the looseness due to movements of the sealing plate assembly 2 in the axial and circumferential directions of the rotor. As a result, the wear and the replacement frequency of the outside sealing plate 11 and the inside sealing plate 12 can be reduced.

Figure 12:
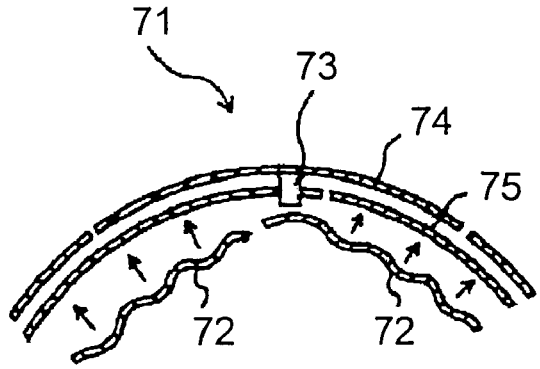
FIG.12 PRIOR ART
FIG. 12 is a cross-sectional view showing a sealing plate assembly of a conventional gas turbine.

Moreover, FIG. 1 through FIG. 3 do not show, but an aforementioned leaf spring 72 being shown in FIG. 12 may further be installed to the inside of the inside sealing plate 12 of a sealing plate assembly 2. By this, the outside sealing plate 11 and the inside sealing plate 12 receive a spring force radially outward of the rotor, thereby increasing the sealing effects between the outside sealing plate 11 and the top surface of the groove portion 4.

In addition, the projecting portion 8 of an overhang portion 3 on the side of the rotor interior has a plurality of openings for insertion (not illustrated) that are cut out circumferentially for a predetermined length. The outside sealing plate 11 and the inside sealing plate 12 can be inserted into the groove portions 4 by being slid circumferentially from the openings for insertion.

In order to replace a sealing plate assembly 2, the outside sealing plate 11 and the inside sealing plate 12 are disassembled by removing the locking bolt 19 from the retaining member 6. Then, the outside sealing plate 11 and the inside sealing plate 12 are taken out through a gap between the overhang portions 3 and through the openings for insertion.

A new outside sealing plate 11 and a new sealing plate 12 are inserted into the groove portions 4 individually from the openings for insertion. The outside sealing plate 11 and the inside sealing plate 12 are piled up so that the sealing plate engagement portions 7 opening in the form of a hole meet, and an intermediate holding member 18 of the retaining member 6 is inserted and engaged into the sealing plate engagement portions 7.

Next, with the grasping member 15 of the retaining member 6 engaged into the disc engagement portions 5, the outside sealing plate 11 and the inside sealing plate 12 are inserted into a gap between the grasping portions 16 of the grasping member 15. After that, a locking bolt 19 is screwed into the bolt hole 17 being provided to the grasping member 15 from the inside of the rotor.

In accordance with the present invention, the outside sealing plate 11 and the inside sealing plate 12 are fixed by tightening the locking bolt 19 through the bolt hole 17 and the sealing plate engagement portions 7, and the sealing plate assembly 2 is fixed inside the groove portions 4 of the rotor discs 60. In accordance with such a construction of the sealing structure 1 as described hereinabove, on-site replacement of the sealing plate assembly 2 is possible without disassembling the rotor discs, resulting in reduction of maintenance costs of a gas turbine.

Figure 5A:
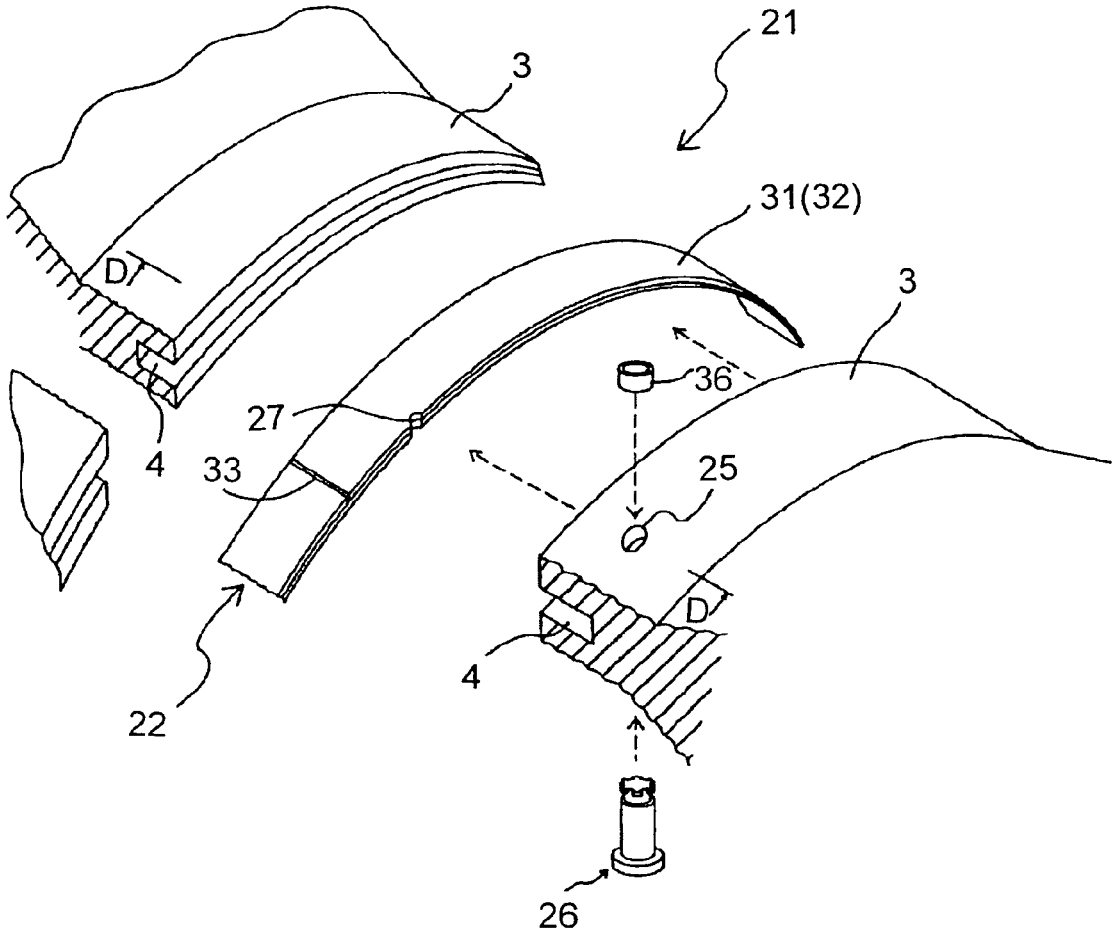
FIG. 5A is a perspective view showing a sealing structure of a gas turbine in accordance with a second embodiment of the present invention.
Figure 5B:
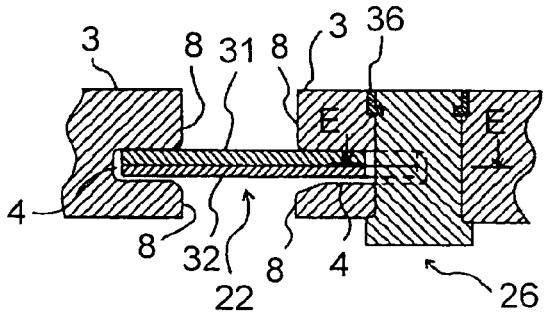
FIG. 5B is a cross-sectional view of FIG. 5A along the line D-D.

Next, FIG. 5A is a perspective view showing a sealing structure of a gas turbine in accordance with a second embodiment of the present invention. Additionally, FIG. 5B is a cross-sectional view of FIG. 5A along the line D-D. As in the first embodiment of the present invention, a sealing structure 21 comprises overhang portions 3 provided to rotor discs 60; groove portions 4 provided to the overhang portions 3; a sealing plate assembly 22 inserted into the groove portions 4; and retaining members 26. The sealing plate assembly 22 consists of an outside sealing plate 31 and an inside sealing plate 32.

The sealing plate assembly 22 is provided to the inside of the groove portions 4 being provided to the overhang portions 3 of the rotor discs 60 (See FIG. 9.) with the outside sealing plate 31 and the inside sealing plate 32 piled up. The outside sealing plate 31 and the inside sealing plate 32 are fixed integrally with the retaining member 26. The number of circumferential partitions of the outside sealing plate 31 and the inside sealing plate 32 and the positional relationship and the like of the dividing portions 33 of the outside sealing plate 31 and the inside sealing plate 32 are the same as the first embodiment of the present invention.

The outside sealing plate 31 and the inside sealing plate 32 are provided with a sealing plate engagement portion 27 in place of the sealing plate engagement portion 7 being composed of a through hole in accordance with the first embodiment (See FIG. 3.). The sealing plate engagement portion 27 is formed in an arc on the borders of the outside sealing plate 31 and the inside sealing plate 32. The sealing plate engagement portion 27 may be provided to only one border or both borders of the outside sealing plate 31 and the inside sealing plate 32.

In addition, in place of the disc engagement portion 5 in the form of a groove in accordance with the first embodiment (See FIG. 1.), is provided a disc engagement portion 25 in the form of a hole. The disc engagement portion 25 is a through hole penetrating the overhang portion 3 radially from the top surface to the bottom surface and can have a retaining member 26 inserted therein. The disc engagement portion 25 is provided to a position where the bottom surface of the groove portion 4 facing to the opening side comes approximately in the center.

Figure 5C:
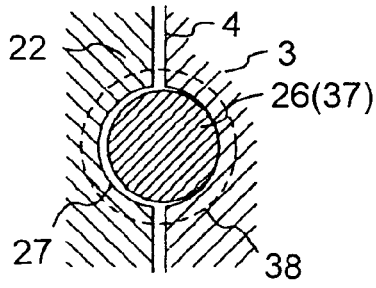
FIG. 5C is a cross-sectional view showing a retaining member of the gas turbine in accordance with the second embodiment of the present invention.

As shown in FIG. 5A, a sealing plate assembly 22 is inserted into the inside of the groove portions 4 with the outside sealing plate 31 and the inside sealing plate 32 piled up so that the sealing plate engagement portions 27 thereof meet. The sealing plate engagement portions 27 are placed so as to overlap the disc engagement portion 25. Then, a retaining member 26 is inserted from the inside of the rotor into the disc engagement portion 25. By this, as shown in FIG. 5C, the sealing plate assembly 22 is fixed to the overhang portion 3 by having the retaining member 26 engaged into the sealing plate engagement portions 27 being formed in an arc.

By being constructed as described hereinabove, the sealing plate assembly 22 is fixed to the rotor disc 60 by way of the disc engagement portion 25, the retaining member 26 and the sealing plate engagement portions 27. Additionally, the sealing plate assembly 22 has movements thereof in the axial and circumferential directions of the rotor inside the groove portions 4 restrained.

Figure 6:
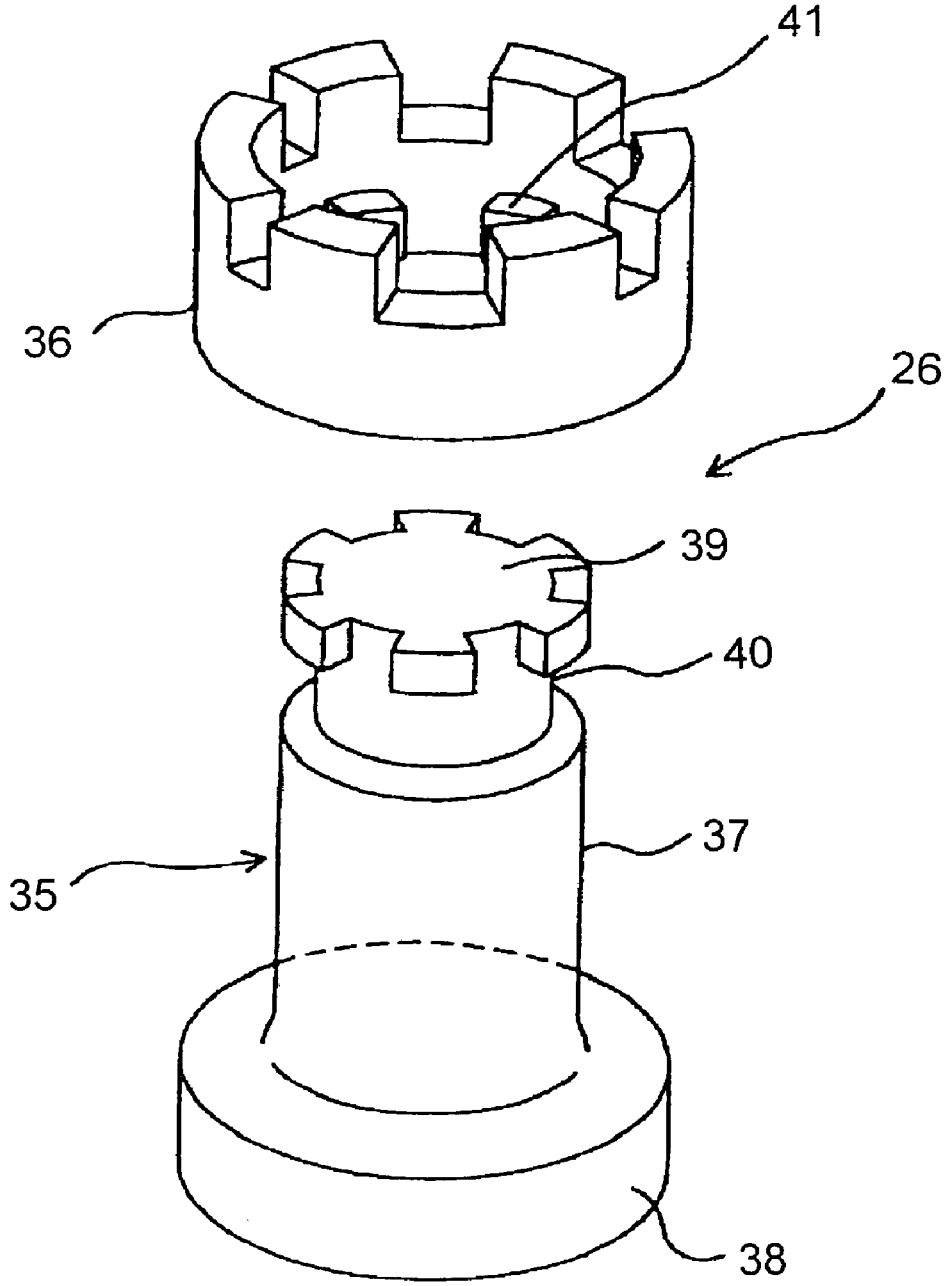
FIG. 6 is a perspective view showing a retaining member of the gas turbine in accordance with the second embodiment of the present invention.

FIG. 6 is a perspective view showing a retaining member 26. The retaining member 26 comprises a locking bolt 35 and a retaining ring 36. The locking bolt 35 has a collar portion 38 having a larger diameter than a bolt body 37 provided to one end of the cylindrical bolt body 37. The other end of the bolt body 37 is provided with a bolt engagement portion 39 having a gear type construction so as to be engageable to the retaining ring 36.

A depressed portion 40 of a bolt having a smaller diameter than the bolt body 37 is provided between the bolt body 37 and the bolt engagement portion 39. In order to receive the protruding portions 41 of the retaining ring 36, the depressed portion 40 of the locking bolt 35 is formed in such a manner as the depth of the depressed portion 40 of the locking bolt 35 is larger than the height of the projecting portions 41.

The retaining ring 36 is formed in a ring and has the inner circumference surface thereof provided with protruding portions 41 having the same pitch as the bolt engagement portion 39 into which the protruding portions 41 are engaged. The inside diameter at the edges of the protruding portions 41 is formed to be larger than the diameter of the bottom of the gear teeth of the bolt engagement portion 39. The radial width of the protruding portions 41 is formed to be smaller than the width of the grooves at the bottom of the gear tooth of the bolt engagement portion 39.

Figure 7:
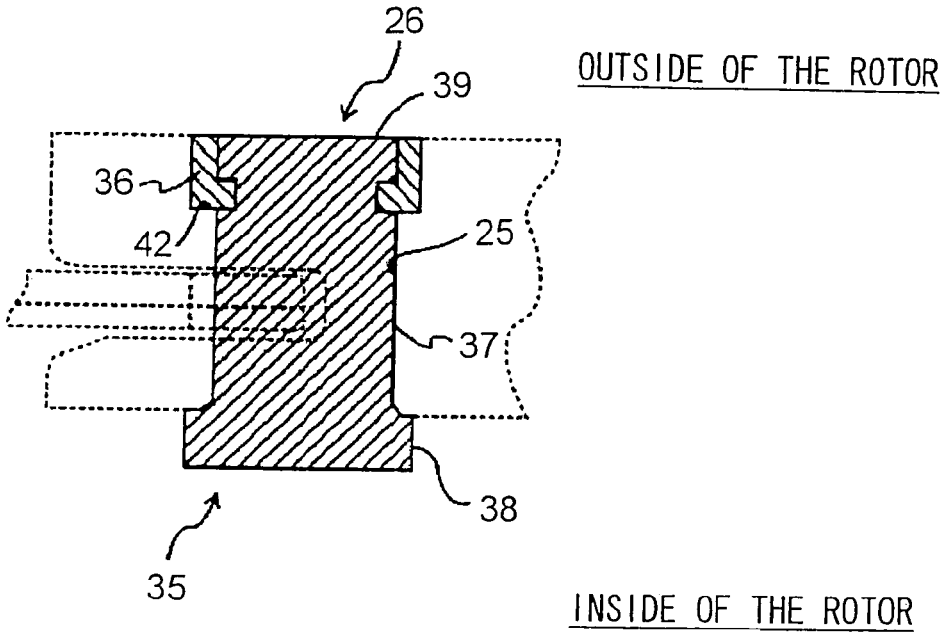
FIG. 7 is a cross-sectional view showing installation state of a retaining member of the gas turbine in accordance with the second embodiment of the present invention.

As shown in FIG. 7, the inner circumference surface of the disc engagement portion 25 being composed of a through hole has a stepped portion 42 installed axially toward the outside of the rotor. By the stepped portion 42, the disc engagement portion 25 has the inside diameter thereof facing the outside of the rotor that is larger than the inside diameter of the disc engagement portion 25 facing the inside of the rotor. With the stepped portion 42 serving as the boundary, the inner circumference surface of the disc engagement portion 25 that has the larger diameter and is located on the side of the rotor outside comes in contact with the retaining ring 36 internally. The inner circumference surface of the disc engagement portion 25 that is located on the side of the rotor inside and has the smaller diameter comes in contact with the bolt body 37 internally.

When the retaining member 26 is installed to the disc engagement portion 25, the bolt engagement portion 39 of the locking bolt 35 is inserted into the disc engagement portion 25 from the inside of the rotor. At this time, the sealing plate assembly 22 being installed to the inside of the groove portions 4 beforehand is placed in a matter that the sealing plate engagement portions 27 in the form of an arc overlap the disc engagement portion 25.

The locking bolt 35 is inserted until the collar portion 38 thereof closely touches the brim of the disc engagement portion 25, and a retaining ring 36 is inserted from the outside of the rotor to be engaged to the disc engagement portion 25. At this time, the retaining ring 36 is rotated so as not to have the protruding portions 41 of the retaining ring 36 interfere with the ridges of the gear construction of the bolt engagement portion 39. By this, the retaining ring 36 is engaged to a predetermined location of the bolt engagement portion 39.

When the retaining ring 36 is pressed inward in the radial direction of the rotor and comes in close contact with the stepped portion 42, the protruding portions 41 reach the depressed portion 40 of the bolt, having the retaining ring 36 rotate. As a result, the protruding portions 41 of the retaining ring 36 come under the teeth of the bolt engagement portion 39, being overlapped, which prevents the retaining ring 36 from coming out. Specifically, by having the teeth of the bolt engagement portion 39 overlap the protruding portions 41 of the retaining ring 36, the retaining member 26 is held in the disc engagement portion 25.

In accordance with the construction as described hereinabove, during normal operation of a gas turbine, the collar portion 38 of the locking bolt 35 is retained, being in close contact with the periphery of the disc engagement portion 25 due to a centrifugal force. On the other hand, while the rotor stops rotating, the stepped portion 42 being provided to the inner circumference surface of the disc engagement portion 25 comes in close contact with the lower surface of the retaining ring 36. As a result, the retaining member 26 is held inside the disc engagement portion 25, thereby preventing the retaining member 26 from dropping into the inside of the rotor.

In accordance with the present embodiment, the sealing plate assembly 22 is fixed to the rotor discs 60 by way of the retaining members 26. Therefore, same as the first embodiment of the present invention, relative movements of the sealing plate assembly 22 do not occur. As a result, looseness of the sealing plate assembly 22 inside the groove portions 4 can be reduced even when the rotor rotates at a low speed. In addition, same as the first embodiment, it is possible to disassemble and replace the sealing plate assembly 22 easily at the site by removing the retaining members 26.

Moreover, because the retaining member 26 is engaged to the disc engagement portion 25 being bored in the overhang portion 3 to retain, the centrifugal force of the retaining member 26 is not applied to the sealing plate assembly 22. As a result, looseness of the retaining member 26 can be mitigated, so that the inner walls of the groove portions 4 and the disc engagement portions 25 will not be damaged. Additionally, being compared with the sealing structure in accordance with the first embodiment, the structure is more simple and the number of components is smaller, so that on-site replacement work becomes further easier.

What is claimed is:

1. A gas turbine comprising:

a plurality of rotor discs, and sealing structures each sealing between the rotor discs adjacent to each other, wherein each of the sealing structures comprises:

a first overhanging portion formed on a rotor disc among the plurality of rotor discs so as to be annularly around a rotor axis, a second overhanging portion formed on another rotor disc among the plurality of rotor discs adjacent to the rotor disc so as to be annularly around the rotor axis and to face the first overhanging portion, a first groove portion formed circumferentially on an end surface of the first overhanging portion, a second groove portion formed circumferentially on an end surface of the second overhanging portion so as to face the first groove portion, disc engagement portions provided to at least one of the first and second overhanging portions, a sealing plate assembly formed on a plurality of annular sealing plates mutually stacked and removably provided in the first and second groove portions, sealing plate engagement portions provided to the sealing plate assembly, and retaining members engaged and fixed to the disc engagement portions and to the sealing plate engagement portions so as to have the sealing plate assembly fixed to the first and second overhanging portions, wherein each of the retaining members comprises a grasping member formed in a U-shape form and sandwiches the sealing plate with two grasping portions that face each other.

2. A gas turbine as described in claim 1, wherein the disc engagement portions are provided so as to house the retaining members respectively; and the sealing plate engagement portions are provided to the sealing plate assembly in a form of holes.

3. A gas turbine as described in claim 2, wherein the sealing plate assembly is formed such that the sealing plates are firmly fixed in an integral manner by the retaining members.

4. A gas turbine as described in claim 1, wherein each of the retaining members has an intermediate holding member inserted into the sealing plate engagement portion.

5. A gas turbine a plurality of rotor discs, and sealing structures each sealing between the rotor discs adjacent to each other, wherein each of the sealing structures comprises:

a first overhanging portion formed on a rotor disc among the plurality of rotor discs so as to be annularly around a rotor axis, a second overhanging portion formed on another rotor disc among the plurality of rotor discs being adjacent to the rotor disc so as to be annularly around the rotor axis and to face the first overhanging portion, a first groove portion formed circumferentially on an end surface of the first overhanging portion, a second groove portion formed circumferentially on an end surface of the second overhanging portion so as to face the first groove portion, disc engagement portions provided to at least one of the first and second overhanging portions, a sealing plate assembly formed on a plurality of annular sealing plates mutually stacked and removably provided in the first and second groove portions, sealing plate engagement portions provided to the sealing plate assembly, and retaining members engaged and fixed to the disc engagement portions and to the sealing plate engagement portions so as to have the sealing plate assembly fixed to the first and second overhanging portions, wherein the disc engagement portions are provided to at least one of the first and second overhanging portions in a form of holes, and the sealing plate engagement portions are provided to a border of the sealing plate assembly in a form of arcs.

6. A gas turbine as described in claim 5, wherein the retaining members are held in the first and second overhanging portions.

7. A gas turbine as described in claim 5, wherein each of the retaining members comprises a locking bolt inserted into a disc engagement portion and a retaining ring holding the locking bolt in one of the first and second overhanging portions.

8. A gas turbine as described in claim 7, wherein the locking bolt has a bolt engagement portion and also has a gear latching structure so that the bolt engagement portion and the retaining ring are engaged to each other to latch together.

9. A gas turbine as described in claim 7, wherein the locking bolt has a collar portion at an end thereof.

10. A gas turbine as described in claim 7, wherein each of the disc engagement portions has a stepped portion provided to an inner surface thereof.

11. A gas turbine comprising:

a plurality of rotor discs, and sealing structures each sealing between the rotor discs adjacent to each other, wherein each of the sealing structures comprises:

a first overhanging portion formed on a rotor disc among the plurality of rotor discs so as to be annularly around a rotor axis, a second overhanging portion formed on another rotor disc among the plurality of rotor discs adjacent to the rotor disc so as to be annularly around the rotor axis and to face the first overhanging portion, a first groove portion formed circumferentially on an end surface of the first overhanging portion, a second groove portion formed circumferentially on an end surface of the second overhanging portion so as to face the first groove portion, disc engagement portions provided to at least one of the first and second overhanging portions, a sealing plate assembly formed on a plurality of annular sealing plates mutually stacked and removably provided in the first and second groove portions, sealing plate engagement portions provided to the sealing plate assembly, and retaining members engaged and fixed to the disc engagement portions and to the sealing plate engagement portions so as to have the sealing plate assembly fixed to the first and second overhanging portions, wherein the retaining members are intermediate holding members attached to the sealing plate assembly, and each of the sealing plate engagement portions is a dent receiving the intermediate holding member.

12. A gas turbine as described in claim 4, wherein the retaining members respectively have bolt holes at the grasping portions thereof, and locking bolts are respectively inserted through the bolt holes and through holes formed in the intermediate holding members.

* * * * *